US005599181A

United States Patent [19]

Aoki et al.

[11] Patent Number: 5,599,181

[45] Date of Patent: Feb. 4, 1997

[54] COMBUSTION APPARATUS HAVING A BUILT-IN STORAGE BATTERY

[75] Inventors: Yutaka Aoki; Yuzuru Watanabe; Kouichi Mitsufuji, all of Hokkaido, Japan

[73] Assignee: Paloma Industries Limited, Nagoya, Japan

[21] Appl. No.: 618,418

[22] Filed: Mar. 8, 1996

[30] Foreign Application Priority Data

Mar. 9, 1995 [JP] Japan ..... 7-079445

[51] Int. Cl.[6] ..... F23N 5/10

[52] U.S. Cl. ..... 431/80; 431/78; 126/39 BA

[58] Field of Search ..... 431/80, 78, 18, 431/64, 42; 126/39 BA, 39 E, 39 G, 39 N; 320/2, 21

[56] References Cited

U.S. PATENT DOCUMENTS

| | | | |
|---|---|---|---|
| 4,565,519 | 1/1986 | Carignan | 431/80 |
| 4,770,629 | 9/1988 | Bohan, Jr. | 431/80 |
| 4,984,981 | 1/1991 | Pottebaum | 431/80 |

FOREIGN PATENT DOCUMENTS

| | | |
|---|---|---|
| 60-60422 | 4/1985 | Japan . |
| 62-29827 | 2/1987 | Japan . |

*Primary Examiner*—James C. Yeung

*Attorney, Agent, or Firm*—Nikaido, Marmelstein, Murray & Oram LLP

[57] ABSTRACT

A combustion apparatus has a built-in storage battery and has circuitry which restores a sufficient amount of stored electrical energy in the storage battery when the amount of electrical energy stored in the storage battery is lowered below a required level. A thermoelectric generator element is heated by combustion heat produced by a burner to generate a thermal electromotive force. A manual operation of a slide button causes an associated multi-contact switch to repetitively turn ON and OFF, such that a coil in a booster circuit boosts a voltage generated by the thermoelectric generator element. The boosted voltage is applied to an oscillator circuit in the booster circuit, so that the booster circuit is driven to boost the voltage from the thermoelectric generator element as well as to start powering the oscillator circuit and a storage battery. Consequently, a sufficient amount of stored electrical energy is restored in the storage battery.

7 Claims, 3 Drawing Sheets

COMBUSTION APPARATUS HAVING A BUILT-IN STORAGE BATTERY

BACKGROUND OF THE INVENTION

1. Field of the Invention

The present invention relates to a burning or combustion apparatus having a built-in storage battery, and more particularly, to a combustion apparatus which utilizes combustion heat generated by the combustion apparatus to charge the storage battery so as to operate electric loads such as an ignitor or the like using the electrical energy stored in the storage battery.

2. Description of the Related Art

Conventionally, in combustion apparatuses adapted to drive associated electric loads by the use of combustion heat generated thereby, there is known a type which comprises not only a thermoelectric generator element serving as a power supply but also a storage battery for storing electrical energy generated by the thermoelectric generator element.

An example of a combustion apparatus having a built-in storage battery is shown in FIGS. 3A and 3B.

The illustrated combustion apparatus, which may be a thermal cooking range, is provided with a thermoelectric generator element 4 for generating a thermal electromotive force, a booster circuit 8 for boosting a voltage generated by the thermoelectric generator element 4, and a storage battery 12 for storing the boosted voltage.

When burning or combustion is started, electrical energy stored in the storage battery 12 is used to operate an ignitor 14 which discharges the supplied electrical energy to ignite a combustible gas. Also, electrical energy is thermally generated by the thermoelectric generator element and stored in the storage battery 12, such that the stored electrical energy can be utilized as driving power for the ignitor 14.

If, however, stored electrical energy in the storage battery is depleted, the storage battery cannot be internally recharged by the thermoelectric generator element 4 and the booster circuit 8 unless the storage battery itself is replaced or the storage battery is externally recharged by another method. This problem will be more specifically discussed below.

Originally, the thermal electromotive force generated by the thermoelectric generator element 4 is too low to directly charge the storage battery 12. The booster circuit 8 is therefore provided for boosting the voltage generated by the thermoelectric generator element 4, whereby the storage battery 12 can be charged by applying the boosted voltage thereto.

However, since the booster circuit 8 is operated with electrical energy stored in the storage battery 12, if an amount of the electrical energy stored in the storage battery 12 is lowered to such a degree that the booster circuit 8 cannot be operated therewith, the storage battery 12 can no longer be recharged by the thermoelectric generator element 4 and the booster circuit 8.

Assuming, for example, that a nickel-cadmium storage battery is used as the built-in storage battery, a minimally required voltage for charging is 1.2 volts. Also, a voltage ranging from 0.6 to 2.0 volts or more is required to drive loads of the apparatus including ignitor 14, other operation lamps, etc. On the other hand, the thermoelectric generator element 4 has a capability of generating a thermal electromotive force of approximately 0.4 volts.

Therefore, the thermal electromotive force generated by the thermoelectric generator element 4 cannot be utilized as it is for charging the storage battery 12, and the booster circuit 8 is therefore required to boost the thermal electromotive force.

Thus, if the voltage stored in the storage battery 12 is lowered to such a degree that the booster circuit 8 cannot be operated with the stored voltage, the storage battery 12 cannot be charged using the thermal electromotive force generated by the thermoelectric generator element 4.

For the reason mentioned above, if an amount of electrical energy stored in the storage battery 12 has been lowered below a required level due to natural discharge which occurs during a period of non-use of the combustion apparatus, the user must take countermeasures, such as external recharging or exchange of the storage battery 12. These countermeasures can be expensive, troublesome, and time-consuming.

Alternatively, a backup power supply must be provided for the storage battery 12, previously supposing a decrease in the stored amount of electrical energy in the storage battery 12. This, however, would end up having the same problems and requiring the same countermeasures as with the system discussed above, if the backup power supply is exhausted.

SUMMARY OF THE INVENTION

It is thus an object of the present invention to provide a combustion apparatus having a built-in storage battery which is capable of solving the above-mentioned problems and conveniently restoring a sufficient amount of stored electrical energy in the storage battery if the stored amount of electrical energy in the storage battery is lowered below a minimally required level.

The combustion apparatus having a built-in storage battery according to the present invention for solving the above problems has a burner for burning combustible gas, and a thermoelectric generator element for generating a thermal electromotive force with combustion heat produced by the burner. A storage battery is provided, and is charged by the thermoelectric generator element for supplying stored electrical energy to electric loads upon starting a combustion operation. A switching element is adapted to turn ON and OFF by electrical energy supplied thereto from the storage battery. Boosting means, including a boosting coil, is provided for boosting a voltage generated by the thermoelectric generator element by changing a coil current using the switching element, and for supplying the boosted voltage to the storage battery. The combustion apparatus also has manual switch means for changing the coil current by a manual ON/OFF operation instead of the switching element.

The combustion apparatus having a built-in storage battery according to claim 2 is such that the manual switch means includes a multi-contact switch which is repetitively turned ON and OFF a plurality of times with a single manual operation.

The combustion apparatus having a built-in storage battery according to claim 3 has an interrupt switch for interrupting the supply of electrical energy to the storage battery and the electric loads from the boosting means, when the manual switch means is being operated.

In the combustion apparatus of the present invention, the manual switching means is manually turned ON and OFF to change the coil current, instead of the switching element, to start the boosting means for boosting a voltage generated by the thermoelectric generator element. More specifically, instead of the switching element which would turn ON and OFF using electrical energy stored in the storage battery, the manual switch means is manually turned ON and OFF to change the coil current to start the boosting means without consuming any electrical energy in the storage battery. As a result, the boosting means boosts the voltage generated by the thermoelectric generator element and starts supplying the storage battery with the boosted voltage.

As a result of this configuration, even when electrical energy in the storage battery has been used up, sufficient electrical energy can be restored in the storage battery without the need to exchange or recharge the exhausted storage battery.

In the combustion apparatus having a built-in storage battery according to claim 2, the multi-contact switch included in the manual switch means can be repetitively turned ON and OFF a plurality of times only with a single manual operation, thus facilitating the starting of the boosting means.

In the combustion apparatus having a built-in storage battery according to claim 3, the interrupt switch interrupts the supply of electrical energy to the storage battery and the electric loads from the boosting means when the manual switch means is being operated.

More specifically, the interrupt switch prevents the storage battery and a combustion starting means from consuming electrical energy while the manual switch means is being operated, so that the coil current is changed by the manual switch means to boost the voltage generated by the thermoelectric generator means to a higher voltage, and the boosted voltage is applied only to the switching element which performs an ON/OFF operation. Thus, the interrupt switch facilitates the starting of the boosting means.

BRIEF DESCRIPTION OF THE DRAWINGS

For a clear understanding of the present invention, reference should be made to the following description and the attached drawings, wherein.

DETAILED DESCRIPTION OF THE PREFERRED EMBODIMENTS

Figure 1A:
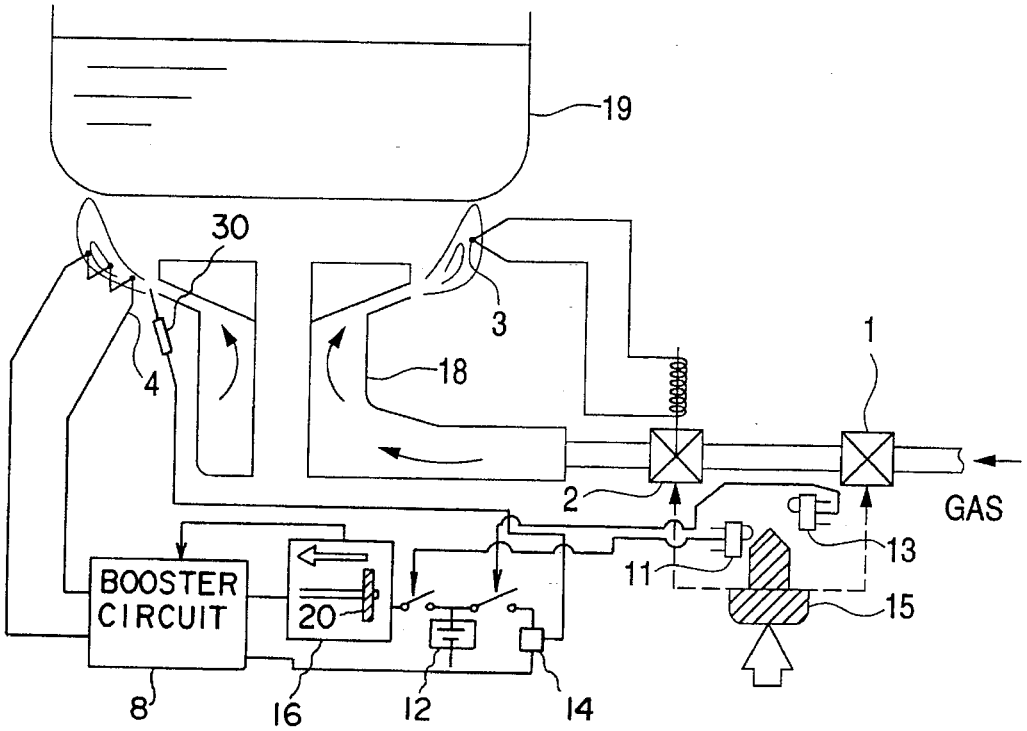
FIGS. 1A and 1B are schematic diagrams showing the configuration of the combustion apparatus having a built-in storage battery according to the present invention.

FIG. 1A shows a thermal cooking range as an embodiment of the combustion apparatus according to the present invention.

Specifically referring to FIG. 1A, the thermal cooking range includes a burner 18 for burning a mixture of combustible gas and air, and a cooking pan 19, carried above the burner 18, which is heated by a flame generated by burning the mixture. The burner 18 is provided with a thermocouple 3 for generating an electromotive force when heated by the flame. At an upstream location on a gas conduit for supplying the burner 18 with the combustible gas, an on-off valve 1 is provided to open the gas conduit by a pushing operation and to close the conduit by the next pushing operation. A magnetic safety valve 2 is arranged at a location downstream of the on-off valve 1. The magnetic safety valve 2 forces the gas conduit to open by a pushing operation and thereafter maintains the gas conduit in an open state by the electromotive force generated by the thermocouple 3.

The thermocouple 3 and the magnetic safety valve 2 are electrically connected in a closed loop to constitute a flame failure safety mechanism for reducing an electromagnetic force of the magnetic safety valve 2 to close the gas conduit if a burning flame fails, thereby causing the thermocouple 3 to generate a lower thermal electromotive force resulting in closure of the gas conduit by the magnetic safety valve.

Figure 1B:
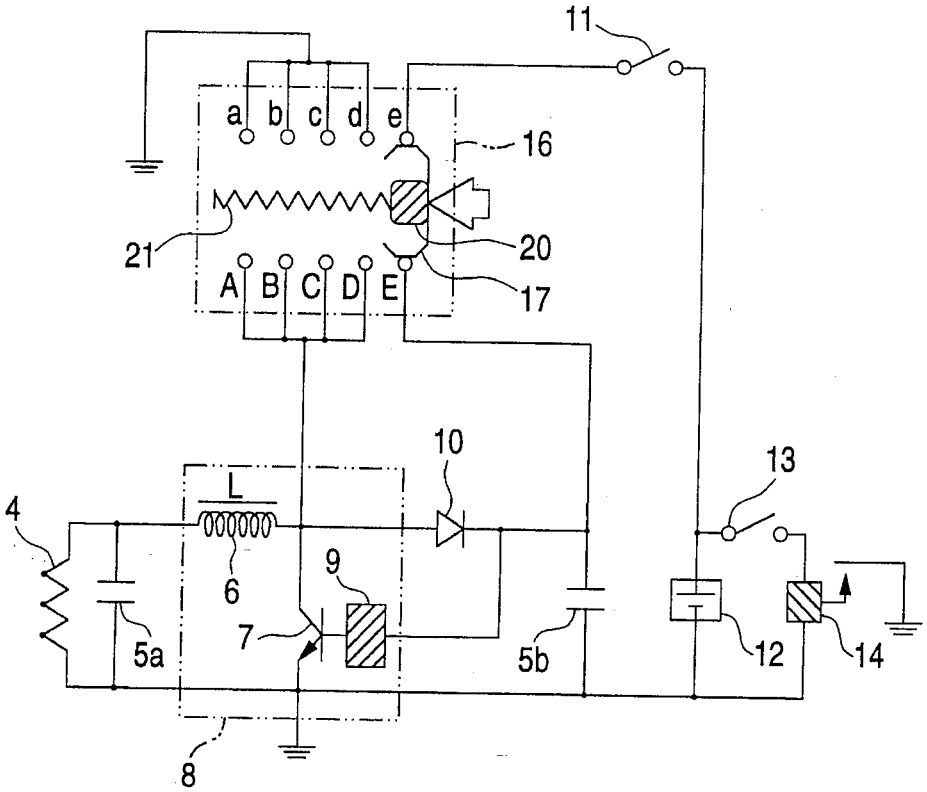

Referring next to FIG. 1B showing an electric circuit configuration of the combustion apparatus, the burner 18 also comprises a thermoelectric generator element 4 for generating a thermal electromotive force by combustion heat produced by the burner 18. The thermoelectric generator element 4 is connected to a booster circuit 8 for boosting a voltage generated by the thermoelectric generator element 4 through a smoothing capacitor 5*a* connected in parallel with the thermoelectric generator element 4.

The booster circuit 8 is composed of an oscillator circuit 9 for generating an oscillating signal, a transistor 7 for performing a switching operation based upon the oscillating signal, and a coil 6 for boosting an output voltage of the thermoelectric generator element 4 by the switching operation of the transistor 7.

In the alternative, the thermoelectric generator element 4 may be formed, for example, of a plurality of serially connected thermocouples in order to provide a higher output voltage.

The booster circuit 8 is connected on its secondary side to a diode 10 which in turn is connected to a storage battery 12 through a contact E of a multi-contact switch 16, and also through a charge switch 11 which turns ON during a combustion operation in association with a pushing operation performed on the magnetic safety valve 2 upon igniting the burner. The oscillator circuit 9 arranged in the booster circuit 8 is connected to the secondary side of the diode 10 through which electrical energy required for the oscillation is supplied thereto. The circuit shown in FIG. 1B also includes a smoothing capacitor 5*b*.

The charge switch 11 is adapted to turn ON at the start of ignition by a spark plug 30 and remain ON during a combustion operation in association with a pushing operation on a manipulation button 15. Charge switch 11 turns OFF when the manipulation button 15 is again pushed so that a flame is extinguished. Thus, the charge switch 11 is turned ON only during the combustion operation to electrically connect the booster circuit 8 with the storage battery 12 through the contact E of the multi-contact switch 16, later described.

The charge switch 11 turns OFF when the manipulation button 15 is further pushed so that a flame is extinguished in the thermal cooking range, so that the storage battery 12 is disconnected from the oscillator circuit 9. Oscillator circuit 9 thereby stops using the electrical energy stored in the storage battery 12, thereby preventing unnecessary consumption of the electrical energy in the storage battery 12.

An ignition switch 13 is also arranged between an ignitor 14 for igniting combustible gas by discharging electrical energy supplied thereto for the burner 18 and the storage battery 12. The ignition switch 13 turns ON in association with a pushing operation on the magnetic safety valve 2 upon ignition and turns OFF when the pushing force on the magnetic safety valve 2 is released.

In addition to the manipulation button 15 used for the ignition, a slide button 20 for starting the booster circuit 8 is provided in a manipulation panel of the combustion apparatus (not shown). This slide button 20 is associated with the multi-contact switch 16 including a plurality of contact pairs A-a–E-e and is urged by a spring 21 toward the contact E (to the right on FIG. 1B).

The slide button 20 is by manual operation configured such that when manually moved toward the contact A, contacts E and e are disconnected, and contacts D and d, C and c, B and b, and A and a, are sequentially connected and disconnected via a contact 17.

The contacts a–d are grounded while the contacts A–D are connected between the coil 6 and the diode 10 in the booster circuit 8.

Next, the operation of the respective components of the combustion apparatus will be described in conjunction with a procedure for ignition and operation of the thermal cooking range with reference to FIGS. 1A and 1B.

First, upon igniting the burner, the manipulation button 15 is pushed to open the on-off valve 1, and the magnetic safety valve 2 is also opened to open the gas conduit.

By turning ON the ignition switch 13 simultaneously with the opening of the valves 1, 2, the ignitor 14 is supplied with electrical energy from the storage battery 12, and discharges the electrical energy for the burner 18 to ignite a mixture, thus starting a combustion operation.

The thermocouple 3 arranged in the burner 18 is heated to generate an electromotive force which in turn leads to generation of an electromagnetic force in an electromagnet (not shown) of the magnetic safety valve 2. The magnetic safety valve 2 remains opened by the action of the electromagnetic force thus generated until a flame is extinguished, even after the pushing force thereon is released.

The thermoelectric generator element 4 is heated by a burning flame to generate a thermal electromotive force. The storage battery 12 supplies electrical energy to the oscillator circuit 9 arranged in the booster circuit 8, such that a voltage generated by the thermal generator element 4 is boosted in the coil 6 by a switching operation of the transistor 7 arranged in the booster circuit 8.

During an initial stage of combustion, the charge switch 11 remains ON by a pushing operation on the manipulation button 15. The slide button 20 is urged by the spring 21 to close between the contacts E-e of the multi-contact switch 16 to electrically connect the booster circuit 8 with the storage battery 12, whereby the voltage boosted by the booster circuit 8 is supplied to the storage battery 12.

If electrical energy stored in the storage battery 12 had been depleted, power would not be supplied to the ignitor 14, thereby causing a failed ignition. In this event, a match or other external flame source may be used to ignite the combustible gas for the burner 18 while the gas conduit is opened with a pushing operation. When combustion is started, the thermoelectric generator element 4 is heated by a burning flame to provide a sufficient thermal electromotive force to hold the safety valve open.

Figure 2A:
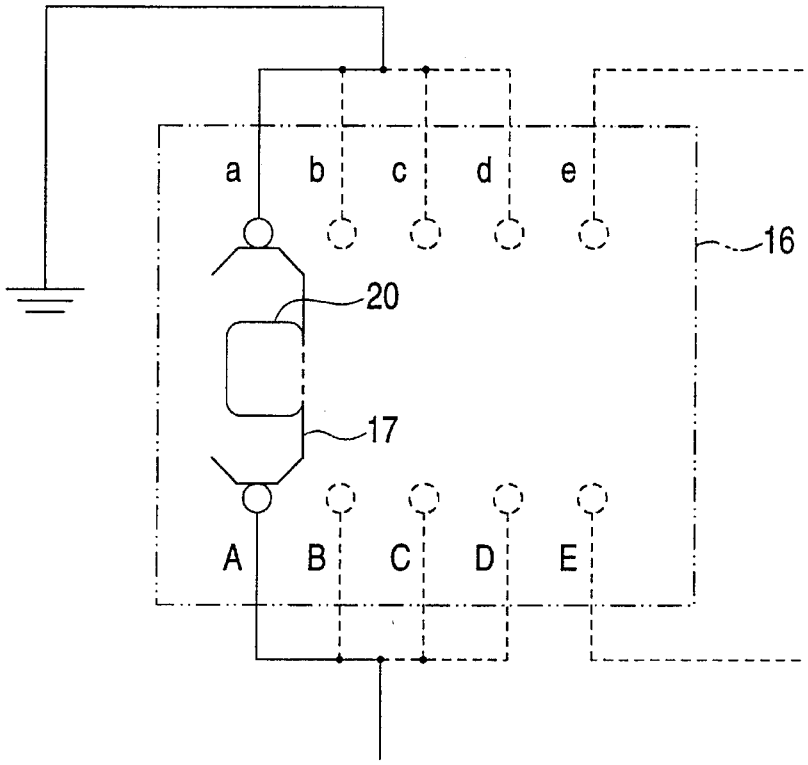
FIGS. 2A and 2B are schematic diagrams showing the operation of the multi-contact switch according to the present invention.
Figure 2B:
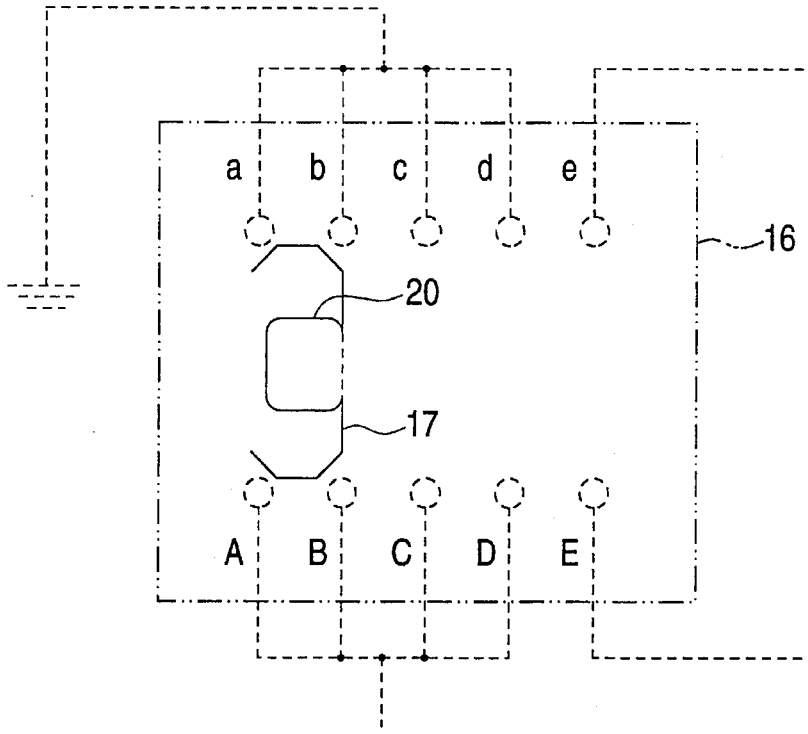
Figure 3A:
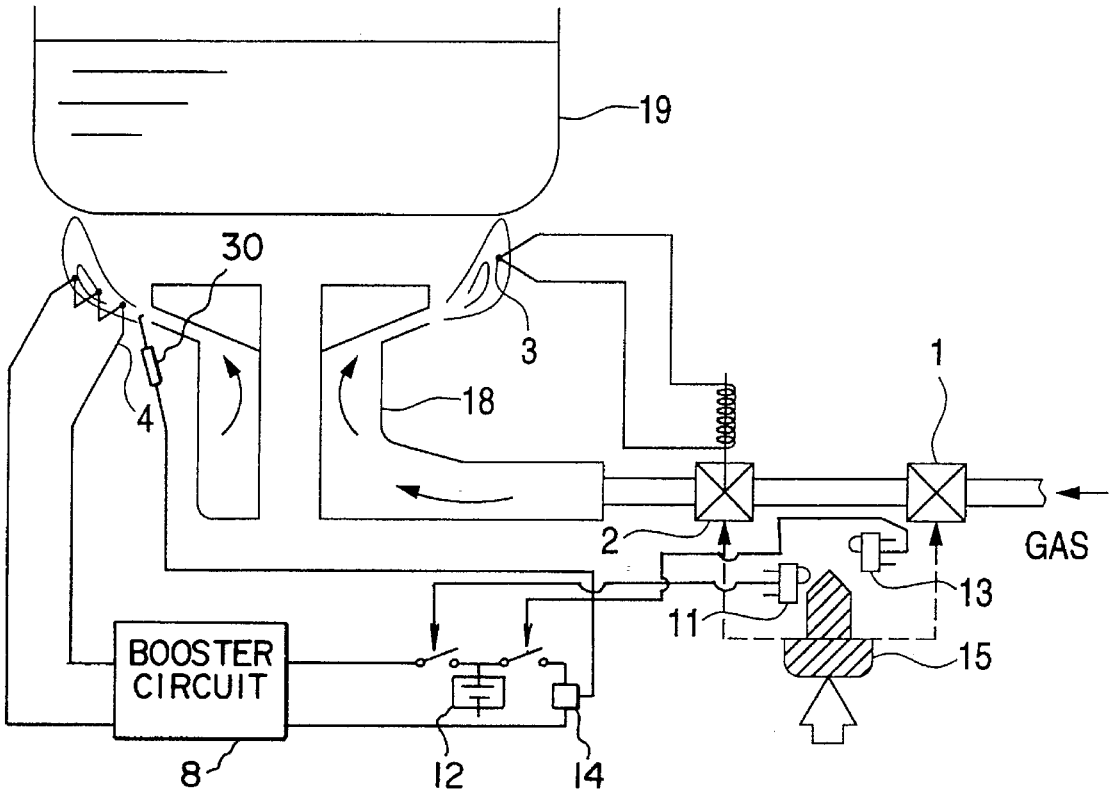
FIG. 3A PRIOR ART
FIGS. 3A and 3B are schematic diagrams showing the configuration of a conventional combustion apparatus having a built-in storage battery.
Figure 3B:
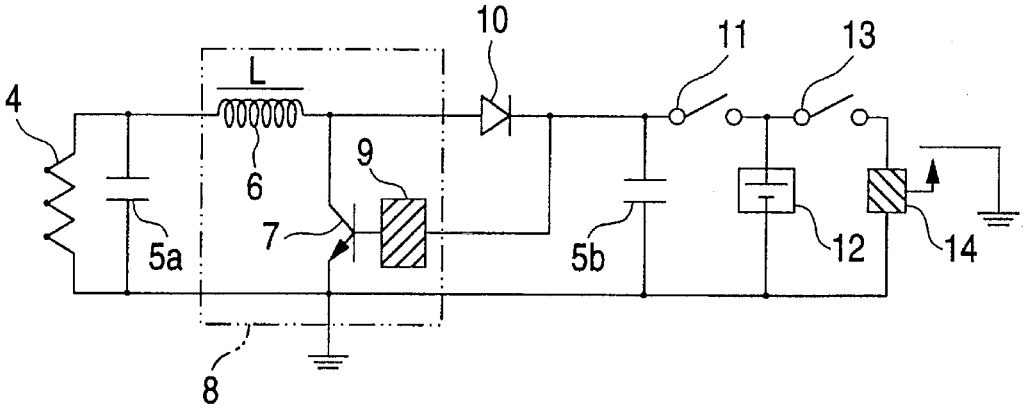
FIG. 3B PRIOR ART

The slide button 20 must be manually moved toward the left in FIG. 1B to sequentially connect and disconnect the respective contact pairs D-d, C-c, B-b and A-a. When the slide button 20 is positioned between the contacts A and a as shown in FIG. 2A, the contacts A and a of the multi-contact switch 16 are electrically connected. Then, when the slide button 20 is being moved from the position between the contacts A and a to a position between the contacts B and b by the force of spring 21, as shown in FIG. 2B, contacts A and a are electrically disconnected.

This ON/OFF switching operation of the multi-contact switch 16 allows the coil 6 arranged in the booster circuit 8 to boost a voltage generated by the thermoelectric generator element 4, and the boosted voltage is supplied to the oscillator circuit 7. Further, when the slide button 20 lies anywhere from a position between the contacts A and a to a position between the contacts D and d, the contacts E and e are electrically disconnected to stop powering the storage battery 12.

In other words, since the power supply to the storage battery 12 is interrupted while the respective contacts of the multi-contact switch 16 are turned ON and OFF, a higher boosted voltage can be generated and applied to the oscillator circuit 9 in the booster circuit 8.

When the oscillator circuit 9 is powered, the transistor 7 arranged in the booster circuit 8 starts the switching operation in accordance with the oscillation period of the oscillator circuit 9, and the booster circuit 8 boosts the voltage generated by the thermoelectric generator element 4.

In a combustion state, the charge switch 11 remains ON. If the slide button 20 is returned to the position between the contacts E and e by the spring 21, the contacts E and e are electrically connected, whereby the boosted voltage produced by the booster circuit 8 is supplied to the storage battery 12.

In this way, as the manual operation for the slide button 20 is repeated, the slide button 20 is returned to the position between the contacts E and e once per reciprocating motion thereof, and an amount of electrical energy stored in the storage battery 12 is gradually increased each time the slide button 20 is reciprocally moved from the position between the contacts A and a to the position between the contacts E and e. Finally, the oscillator circuit 9 is operated with the stored electrical energy in the storage battery 12 to cause the booster circuit 8 to operate even without manually operating the slide button 20 for starting the booster circuit 8.

Thus, by moving the slide button 20 to turn ON and OFF the respective contact pairs A-a–E-e of the multi-contact switch 16, the booster circuit 8 is started to boost the voltage generated by the thermoelectric generator element 4, and the storage battery 12 is charged by applying the boosted voltage thereto. In other words, a user or an operator would be instructed to use slide button 20 in situations where it is known that the power in storage battery 12 has been depleted, and that it is therefore necessary to apply boosted voltage thereto. In situations where the storage battery is not depleted, the use of slide button 20 would not be necessary.

With the foregoing configuration, the booster circuit 8 can be started by manually operating the slide button 20 for starting the booster circuit, instead of driving the oscillator circuit 9 which requires electrical energy stored in the storage battery 12, even if the storage battery 12 does not store necessary electrical energy. It is therefore possible to restore sufficient electrical energy in the storage battery 12 even after the storage battery 12 is exhausted. In addition, since the storage battery 12 can be recharged by a simple operation, the storage battery 12 may be free of maintenance.

While one embodiment of the present invention has been described, the present invention is not at all limited by the described embodiment, and the present invention may be implemented in a variety of different ways without departing from the spirit and scope of the disclosed embodiment.

For example, the present invention is not limited to thermal cooking ranges but may be applied to any devices using combustible gas such as a rice steamer, oven, stove, boiler, and so on, which do not require commercially supplied electrical power.

The contact pair E, e arranged in the multi-contact switch 16 in the foregoing embodiment may be separately provided instead of being incorporated in the multi-contact switch 16. In this case, however, the multi-contact switch 16 should be modified such that either of the contacts A–D remaining ON is not continuously grounded.

While the number of contact pairs included in the multi-contact switch 16 is selected to be four except for the contact pair E-e in the foregoing embodiment, any number of contact pairs may be provided in the multi-contact switch 16. For example, assuming the employment of a switch having a pair of contacts (a contact pair corresponding to the contact pair E-e is separately provided) which are connected by pushing the switch and disconnected by detaching the switch, if the switch is rapidly pushed and detached to perform repetitive ON and OFF operations, a similar effect will result.

Further, instead of sharing the booster circuit 8 by the oscillator circuit 9 and the multi-contact switch 16, a dedicated booster circuit may be separately provided for the multi-contact switch 16.

As a means of igniting the burner when the storage battery 12 is low on stored electrical energy, the present invention is not limited to the use of a match or external flame source for the ignition thereof. The combustion apparatus may be configured to include a piezoelectric ignitor or other ignitor which does not require externally supplied electrical power for this purpose.

As described above in detail, according to a combustion apparatus of the present invention, when an amount of stored electrical energy in an storage battery is below a required level, a sufficient amount of electrical energy can be restored in the storage battery using an inexpensive, easy to operate device without requiring replacement of the storage battery, recharge of the storage battery by means of an external recharger, or externally supplied electrical power.

The combustion apparatus having a built-in storage battery according to claim 2 only requires a single manual operation of the slide button or manual switch means for efficiently turning ON and OFF the multi-contact switch for recharging the storage battery, when electrical energy stored in the storage battery has been used up, thus facilitating the starting of the boosting means.

The combustion apparatus having a built-in storage battery according to claim 3 boosts a voltage generated by the thermoelectric generator element and concentratively applies the boosted voltage to the switching element, thus facilitating the starting of the boosting circuit.

An important advantage of the invention, therefore, is that even after a long unused period, the combustion apparatus can be prevented from being rendered unusable due to an exhausted storage battery.

What is claimed is:

1. A combustion apparatus having a built-in storage battery, said apparatus comprising:

a combustible gas source for supplying a combustible gas;

a burner for burning the combustible gas;

a thermoelectric generator element for generating a thermal electromotive force based upon combustion heat produced by said burner;

a storage battery coupled to said thermoelectric generator element and charged thereby, said storage battery for supplying stored electrical energy to electric loads upon a starting of a combustion operation;

a switching element connected to said storage battery and configured to turn ON and OFF by electrical energy supplied thereto from said storage battery; and boosting means coupled to said thermoelectric generator element, said switching element, and said storage battery, said boosting means including a boosting coil and a switching element, said switching element turning ON and OFF based upon electrical energy supplied from said storage battery, said boosting means for boosting a voltage generated by said thermoelectric generator element by changing a coil current in said boosting coil, and for supplying the boosted voltage to said storage battery; and manual switch means coupled to said boosting means for changing the coil current by a manual ON/OFF operation, wherein the manual ON/OFF operation of said manual switch means replaces said switching element when said storage battery is in a low power condition.

2. A combustion apparatus having a built-in storage battery according to claim 1, wherein said manual switch means includes a multi-contact switch which is configured to repetitively open and close a current path a plurality of times with a single manual operation.

3. A combustion apparatus having a built-in storage battery according to claim 1, comprising an interrupt switch for interrupting the supply of electrical energy to said storage battery and the electric loads from said boosting means, when said manual switch means is being operated.

4. A combustion apparatus according to claim 1, further comprising burner safety shut off device coupled to said combustible gas source, said burner safety shut off device including a flame detection means for detecting a flame at said burner, said burner safety shut off device preventing flow of the combustible gas from said combustible gas source to said burner when no flame is detected by said flame detecting means.

5. A combustion apparatus as recited in claim 4, wherein said burner safety shut off device comprises a magnetic safety valve and wherein said flame detecting means comprises a thermocouple, and wherein said thermocouple generates a sufficient electromagnetic force when a flame is present such that said magnetic safety valve is held open, and wherein no flame is present, the electromagnetic force reduces to a point where the magnetic safety valve closes, thereby preventing flow of the combustible gas to the burner.

6. A combustion apparatus according to claim 1, wherein said thermoelectric generator element comprises a plurality of serially connected thermocouples.

7. A combustion apparatus according to claim 1, further comprising ignition switch means for initiating an ignition of the combustible gas by said burner, said ignition means being coupled to said storage battery and said booster circuit.

* * * * *